US009163301B2

(12) United States Patent
Jung et al.

(10) Patent No.: US 9,163,301 B2
(45) Date of Patent: Oct. 20, 2015

(54) METHOD OF PRODUCING TIN EMITTED LOW ALPHA RADIATION BY USING VACUUM REFINING

(76) Inventors: Jaepil Jung, Seoul (KR); Santosh Kumar, Seoul (KR); Dohyun Jung, Daegu (KR); Yongcheol Chu, Ulsan (KR); Hyunkyu Lee, Ulsan (KR); Cheolhee Kim, Ulsan (KR)

( * ) Notice: Subject to any disclaimer, the term of this patent is extended or adjusted under 35 U.S.C. 154(b) by 121 days.

(21) Appl. No.: 14/115,712

(22) PCT Filed: Jun. 5, 2012

(86) PCT No.: PCT/KR2012/004422

§ 371 (c)(1),
(2), (4) Date: Nov. 5, 2013

(87) PCT Pub. No.: WO2012/169760

PCT Pub. Date: Dec. 13, 2012

(65) Prior Publication Data

US 2014/0060252 A1 Mar. 6, 2014

(30) Foreign Application Priority Data

Jun. 7, 2011 (KR) ..... 10-2011-0054490

(51) Int. Cl.

| | |
|---|---|
| ***C22B 7/00*** | (2006.01) |
| ***C22B 25/08*** | (2006.01) |
| ***C22B 9/04*** | (2006.01) |
| ***C22C 13/00*** | (2006.01) |
| ***C22B 3/00*** | (2006.01) |

(52) U.S. Cl.

CPC ..... *C22C 13/00* (2013.01); *C22B 7/006* (2013.01); *C22B 9/04* (2013.01); *C22B 25/04* (2013.01); *C22B 25/08* (2013.01)

(58) Field of Classification Search

CPC ..... C22B 7/006; C22B 25/08; C22B 9/004; C22B 25/04; C22B 9/04

See application file for complete search history.

(56) References Cited

U.S. PATENT DOCUMENTS

| | | | | |
|---|---|---|---|---|
| 4,027,861 | A * | 6/1977 | Cherednichenko et al. | 266/149 |
| 2009/0098012 | A1 * | 4/2009 | Shindo et al. | 420/559 |

FOREIGN PATENT DOCUMENTS

| | | | | |
|---|---|---|---|---|
| GB | 2204063 | A * | 11/1988 | C22B 25/08 |
| JP | 11080852 | A * | 3/1999 | C22B 25/08 |

OTHER PUBLICATIONS

Oomura et al. Japanese Patent 11080852 A published Mar. 1999. Machine translation.*

Lee, Goon-Hee. Japanese Patent 2007-132654 A published May 2007. Machine translation.*

* cited by examiner

*Primary Examiner* — George Wyszomierski
*Assistant Examiner* — Tima M McGuthry Banks
(74) *Attorney, Agent, or Firm* — G W i P S

(57) ABSTRACT

A method of producing a purified tin, which emits low alpha radiation by using a vacuum refining has developed: the steps are comprising: preparing a crude tin; containing the crude tin in a crucible and placing it in a vacuum furnace; and removing the impurities, which have higher vapor pressures and low boiling points than that of the tin from the vacuum furnace. The impurities, such as a lead and bismuth can be removed as much as possible by utilizing the difference of the vapor pressure of the elements in the tin. It is possible to minimize the emission of alpha radiation, so that it can be prevented the occurrence of the software errors.

5 Claims, 3 Drawing Sheets

METHOD OF PRODUCING TIN EMITTED LOW ALPHA RADIATION BY USING VACUUM REFINING

BACKGROUND OF THE INVENTION

1. Field of the Invention

The present invention relates to a method of producing tin, which is emitting the low alpha radiation by using a vacuum refining. More particularly, the impurities, such as a lead and a bismuth in the tin ore, which are the major sources of emitting the alpha radiation caused to incur the software errors in the electronic devices are removed as much as possible by utilizing the different vapor pressure of each element. So that, the emission of the alpha radiation will be minimized to prevent the occurrence of the software errors.

2. Related Prior Art

Generally, the Tin (Sn) is the main component of the soldering (main material of the solder). It is widely used for manufacturing the semiconductor component; and for connecting the semiconductor chip to the substrate; for bonding the silicon (S chip, such as a IC or LSI, to the lead frame or the ceramic package; and for forming the bump or using the wiring materials to produce the TAB (Tape Automated Bonding) or the Flip Chip.

Meanwhile, the European Union as of Jun. 1, 2006 has established the Restriction of Hazardous Substances Directive (WEEE; Waste Electrical and Electronic Equipment) and the Disposal of Electrical and Electronic Equipment (RoHS; Restriction of Hazardous Substances). The regulation has executed to prohibit the lead used in the electronic devices. Due to impact of this regulation, most of the electronic products have manufactured by using un-lead solder, which has not contained the impurities, such as a lead.

In addition, the tin as a raw material is recently used for the semiconductor component to be high-density and high-capacity. Because the tin placed near by the semiconductor chips and emitted large amount of alpha radiation, it causes a risk to loss the information in the memory cells incurring the software error (Soft error).

Generally, the crude tin emits alpha particles in a range of 2~5 counts/$cm^2$ hr, whereas the purified tin emits alpha particles in a range of low alpha radiation below 0.5 counts/$cm^2$ hr, preferably below 0.02 counts/$cm^2$ hr, more preferably below 0.001 counts/$cm^2$ hr.

The soft error occurs due to existence of the isotopes, such as a lead and bismuth in a tin or solder. In general, the industrial tin has contained the impurity elements ($^{210}Pb$, $^{210}Bi$, $^{210}Po$, etc.), which is a kind of radiation emitting the high-energy alpha particles.

Relating to this fact, the IBM has discovered in 20 years ago that the $^{201}Pb$ has a decay chain. As a result, it has verified that the emission of the alpha particle of about 5.4 MeV caused to occurrence of the software errors.

In other words, as shown in FIG. 1, the half-life of $^{210}Pb$ is 22.3 years via beta decay of $^{210}Bi$, $^{210}Po$ converted to $^{206}Pb$. When the $^{210}Po$ decays to $^{206}Pb$, it will emit the alpha particle of about 5.6 MeV.

For an example, when the high-energy alpha radiation irradiates the data stored in the memory component or recording device, it causes to disturb the data in a semiconductor device to occur the software errors. The charge energy is strong enough to convert the digital signal "0 to 1" or "1 to 0" in the recording devices or the memory component, it will be a serious problem.

As a result, a highly purified tin is required as the main material of soldering the semiconductor component. Especially, it is required the tin, which is emitted the lower alpha radiation.

For instance, the conventional technology has disclosed for manufacturing the tin, which emits the low alpha radiation in Japanese Patent Registered No. 2754030, Japanese Patent H11-343590 and Japanese Patent H01-283398.

In other words, the Japanese Patent Registration No. 2754030 disclosed, "a method for producing the highly purified tin." It has disclosed that the highly-purifying solution of a sulfuric acid or hydrochloric acid, such as a super sulfuric acid or hydrochloric acid is used as the electrolyte, and the highly-purified tin is used as an anode for electrolysis. It has also disclosed the technology to obtain the purified tin as of the low concentrated lead, which has the alpha ($\alpha$) lay as low level of counting number of 0.005 cph/$cm^2$.

In addition, the Japanese Patent No. H11-343590 related to the technology of "method of producing the high-purity tin" disclosed that an aqueous solution contained the crude metal tin is added the acetic acid to heat, and precipitating the meta-tartaric acid, then filtered. After washing this meta-tartaric acid, it will be dissolved in the hydrochloric acid or hydrofluoric acid, then the metal tin of over 5N is extracted from the dissolution solution as the electrolyte by the electrolysis.

Further, the Japanese Patent No. H01-283398 related to the technology of "Tin and its manufacturing method" disclosed that the super sulfuric acid is used as a reagent for the electrolytic to obtain the tin, which has more than 99.99% of purity and the level of a radiation particle counting number about 0.03 cph/$cm^2$.

SUMMARY OF THE INVENTION

However, the conventional technology relating to produce a tin, which emits the low alpha radiation, uses a method of electrical decomposition to remove the impurities in the tin through the electrochemical refining. Due to the mass-disposal of the toxic chemical contaminants, there is high risk to occur the failure in the finished electronic products, as well as problem of the complex processing.

Additionally, according to aforementioned conventional method, because the reduction potential of the tin is almost the same the lead, it is very difficult to remove the lead through the electrolysis. It can be removed to some extent of the impurities, such as a lead, bismuth, and arsenic, but it is impossible to remove the impurities in the level of ppb (Parts Per Billion). The impurities in the tin still have caused the problems of the software errors.

In order to solve the above problems, the purpose of the present invention is to provide a method of manufacturing the pure tin. The impurities, such as a lead and bismuth, which are the main sources of emitting the alpha radiation, can be removed as much as possible by utilizing the difference of the vapor pressure of the elements in the tin. It is possible to minimize the emission of alpha radiation by using the vacuum refining, so that it can be prevented the occurrence of the software errors.

In other words, the objective of the present invention is to provide a method of producing the pure tin that; the impurities, such as a lead and bismuth are removed from the crude tin, until it reaches the level of "ppb", which is less than "ppm" (parts per million) or it will be a level that cannot be detected by the ICP-MS (Inductively Coupled Plasma Mass Spectrometry). The impurities are removed below LC3 level (Low count class) of the alpha radiation emission by vacuum refining to inhibit the occurrence of software errors.

The objective of the present invention is to provide a method of producing a purified tin, which emits low alpha radiation by using a vacuum refining, the method is comprised of the steps of: (A) preparing a crude tin (S110); (B) containing the crude tin in a crucible and placing it in a vacuum furnace (S150), and (C) removing impurities, which have higher vapor pressures and low boiling points than that of the tin from the vacuum furnace (S160).

Preferably, the pre-processing steps are further comprising between the steps (A) and (B): (A1) washing the tin with a hydrochloric acid (S120); and (A2) washing said tin, which is washed through the previous step (A1) with either one of an acetone, ethanol or distilled water, then drying it (S130).

More preferably, the step (B) is further comprised of an inter-step: cleaning inside of the crucible, which will be contained the crude tin, and placed in the vacuum furnace, with the hydrochloric acid (S140).

Also, the steps are further comprising after the step (C): (D) cooling the vacuum furnace until it reaches approximately 20° C.~30° C. at cooling rate of 5° C.~30° C. per minute and removing the impurities from the tin (S170); and (E) washing the tin, which is removed impurities with nitrogen gas and removing contaminated particles (S180).

Further, the preparing step (A) is comprised of a detail step in order to obtain a large surface area per a volume; forming the crude tin in either one of; a grain shape through granularity; a thin sheet shape through press-rolling; or a wide plate shape through casting.

Preferably, the purified tin contains a silver or copper in to be a tin-based alloy.

Also, the removing step is further comprising: a step of supplying steam to the vacuum furnace depending on conditions of temperature 1000° C.~1300° C., pressure 0.01~30 millitorr and 2-6 hours to remove the impurities from the tin.

According to the present invention of a method of producing purified tin, which emits the low alpha radiation by using vacuum refining, it has a merit that most of the impurities, such as a lead and bismuth can be removed by utilizing the difference of the vapor pressure of the elements in the tin, so that it can be minimized the emission of the alpha radiation to prevent the occurrence of the software errors in the electronic devices. It has another merit that there is no disposal problem, so that it does not contaminate the environmental.

In addition to the above objects, the advantages and other objects of the present invention will be apparently revealed through the detailed description of the embodiments with reference to the accompanying drawings.

DETAILED DESCRIPTION OF THE PREFERRED EMBODIMENTS

Figure 1:
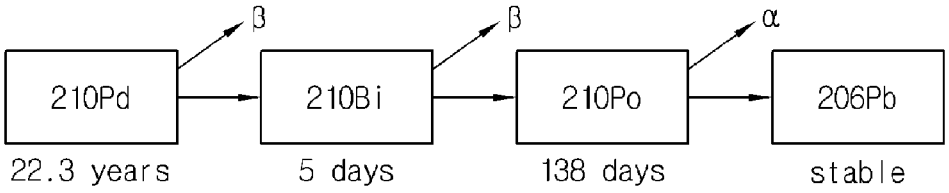
FIG. 1 is a common block diagram illustrating the collapse of $^{210}$Pb and the emission of the alpha & beta radiation of the present invention.

Hereinafter, a method of producing the purified tin, which is emitting the low alpha radiation by using a vacuum refining of the present invention, will be described in detail with reference to the accompanying drawings.

First of all, it should be aware that the same component or same part in the figures, an identical reference numeral is used as possible to represent. Also, it should be noted that the detail descriptions, which are related to the known functions or components will be omitted in order to unambiguous the gist of present invention.

Figure 2:
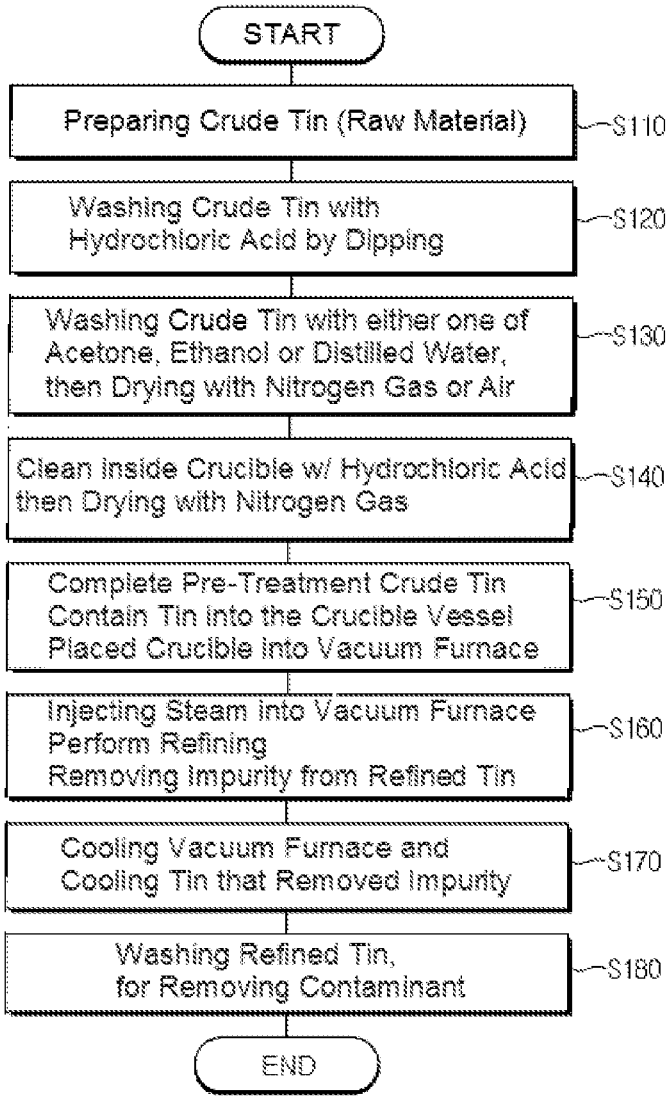
FIG. 2 is a flow chart illustrating a method of producing a purified tin, which emits the low alpha radiation by using vacuum refining according to the present invention.
Figure 3:
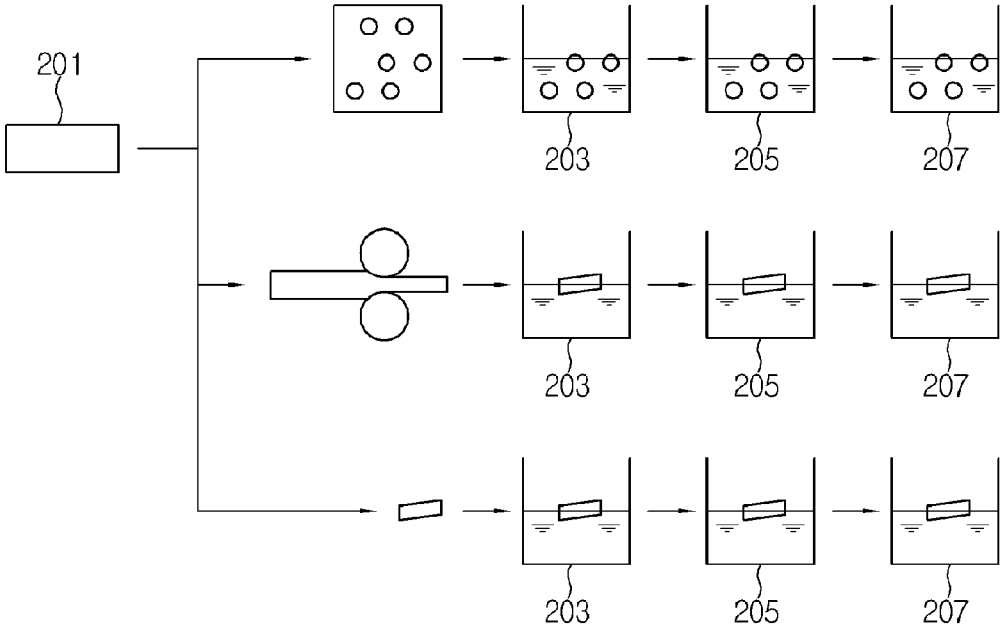
FIG. 3 is a schematic view to prepare the crude tin for applying to the present invention.
Figure 4:
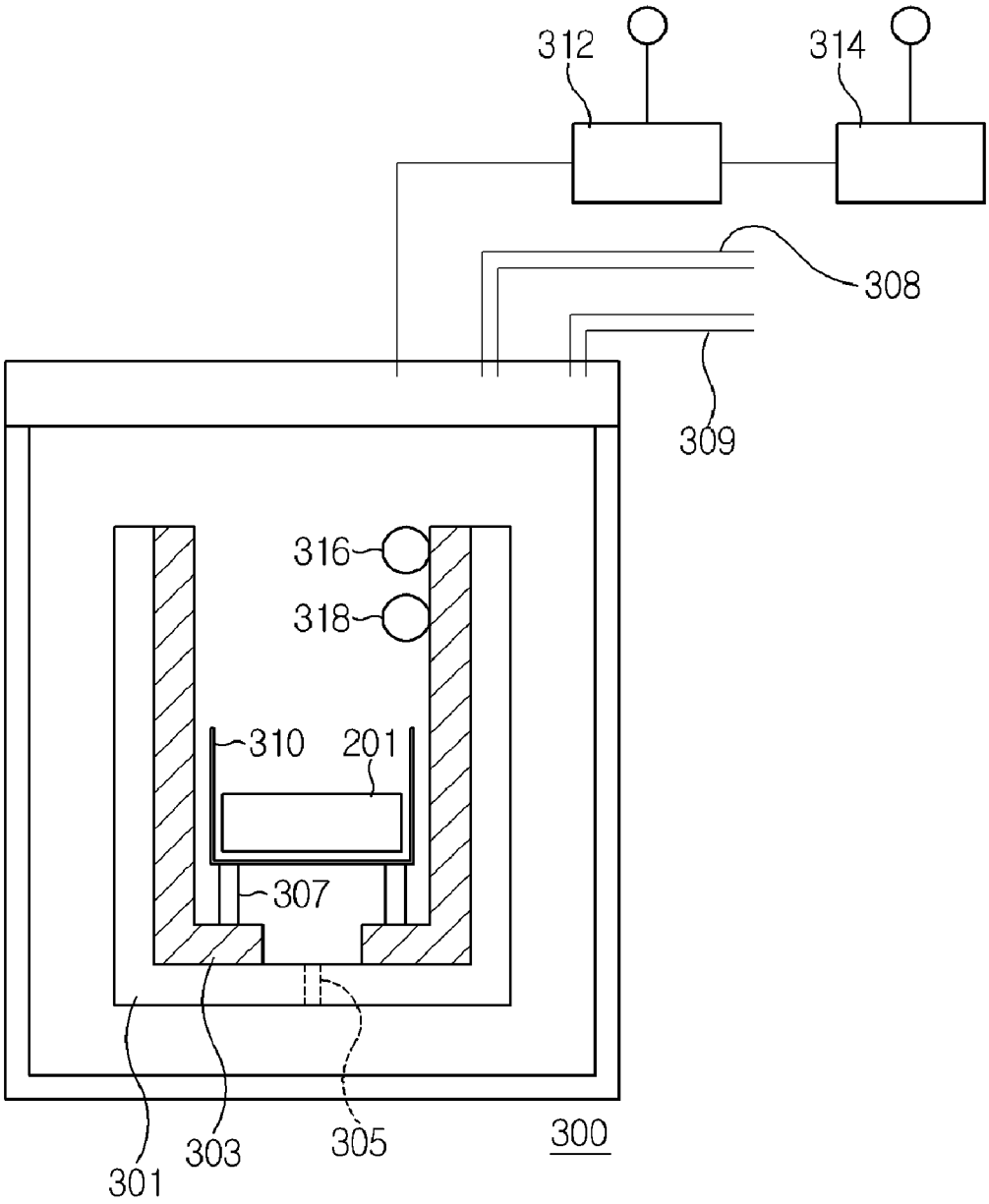
FIG. 4 is a schematic view to prepare the vacuum finery for applying to the present invention.

FIG. 2 is a flow chart illustrating a method of producing a purified tin, which emits the low alpha radiation by using vacuum refining according to the present invention. FIG. 3 is a schematic view to prepare the crude tin for applying to the present invention. FIG. 4 is a schematic view to prepare the vacuum finery for applying to the present invention.

As shown in FIG. 2 and FIG. 3, for producing a purified tin, which emits the low alpha radiation by using vacuum refining according to the present invention, first, prepares the crude tin (201) having 99% to 99.99% purity as the raw material (S110).

At this point, the crude tin is formed either one of a grain shape through granularity, a thin sheet shape through press-rolling, or a wide plate shape through casting in order to obtain a large surface area per a volume.

In addition, the tin is explained for an example as the raw material of the solder in the present specification, but the tin-based alloy could be used, which contains for an example, 1.0 wt % to 3.0 wt % of silver (Ag) or 0.4 wt % to 0.8 wt % of copper (Cu).

Next, as a pre-treatment process, the crude tin prepared thru the previous steps S110 (201) washes with a diluted hydrochloric acid (203) solution (7-12%) by dipping into a washing tank approximately 5-10 minutes (S120).

Subsequently, the washed crude tin (201) thru the step S120, will wash again dip into a tank, which contains the acetone (205), or ethanol or distilled water (207) soaked in there, and then dry the washed tin (201) with nitrogen or air (S130).

In addition, as shown in FIG. 4, the crucible (310), which is containing the tin (201) and placed inside of a vacuum-furnace (300) is prepared to wash with the hydrochloric acid approximately 50~60 minutes, then dry with a nitrogen gas (S140).

At this time, the crucible (310) formed a vessel made of a quartz or alumina plate. Particularly, it is preferable to use the vessel made of the highly-purity quartz plate in order to prevent the impurities penetrating into the tin.

Here, the vacuum furnace (300) can be removed the impurities, such as a lead and bismuth from the tin by using the different vapor pressure of each element. The impurities which are the main source of emitting the alpha radiation are removed as much as possible to minimize the emission of radiation. Generally, it is possible to use the electric tube or box shaped or other-type of non-vacuum furnace, which are known in the art.

As an example, the vacuum furnace (300) according to one embodiment of the present invention, as shown in FIG. 4, a U-shaped supporting frame (301) has formed with the graphite inside walls and the bottom floor (303). A vacuum outlet (305) is formed through the graphite bottom floor (303) partially and the supporting frame (301). A plurality of supporting legs (307) is vertically installed on the graphite bottom floor (303) to suspend the crucible (310). The crucible (310) equipped vessel for containing the crude tin has mounted on top of the supporting legs (307). A water inlet (308) and water outlet (309) is formed on the upper part of the crucible (310) for injecting the water to generate the steam. A diffusion pump (312) as a vacuum pump is provided to discharge or diffuse the steam with high speed for obtaining the high vacuum. In order to easily get the vacuum, a secondary rotary pump (314) acting as diffusion pump (312) is installed.

In addition, the vacuum furnace (300) is provided a pressure gage (316) for measuring the inside vacuum pressure and a thermocouple (318) for measuring the internal temperature. On the outside of the vacuum furnace (300), a controller (not shown) is provided to monitor the internal temperature, pressure and time to set up for operating the vacuum furnace (300).

On the other hand, after pre-treatment process of the step S120 to step S140, the crude tin (201) is loaded into the crucible (310) vessel and placed the crucible into the vacuum furnace (300). (S150)

Next, the steam is supplied to the vacuum furnace (300) in accordance with the predetermined temperature, pressure and setting time. The impurities, such as a lead, bismuth, antimony, and arsenic, which have a higher vapor pressure and the lower boiling point than that of the tin (201) are removed from the crude tin (S160).

In this case, the operating temperature is 1000° C.~1300° C., the pressure from 0.01 to 30 mm Tor (millitorr), and the operating time is preferably 2 to 6 hours. The vacuum furnace (300) is desirably heated up to the temperature of 1000° C.~1300° C. at a rate of 5° C.~30° C. per minute.

In other words, the method of manufacturing the tin that emits lower alpha radiation by the vacuum refining according to the present invention is used the different vapor pressure of the impurity components, such as a lead, bismuth and antimony. The impurities, such as a lead, bismuth and antimony having the high vapor pressure and low boiling point can be separated from the tin by distillation.

Specifically, the tin has the lower melting point and higher boiling point. As seen in Table 1 below, the tin contains a lead, bismuth and antimony. The impurities have the lower-boiling point and the higher vapor pressure at the same temperature compared to the tin. So, it is possible to remove the impurities having the lower boiling point by vacuum distillation.

TABLE 1

| component | Melting Point (M.P(K)) | Boiling Point (B.P(K)) | Vapor Pressure(Pa) 800 K | 1000 K | 1200 K | 1400 K | 1600 K | 1800 K |
|---|---|---|---|---|---|---|---|---|
| Tin (Sn) | 505 | 2875 | $1.26 * 10^{-9}$ | $8.62 * 10^{-6}$ | $3.1 * 10^{-3}$ | 0.207 | 4.85 | 56.3 |
| Lead (Pb) | 600 | 2022 | $6.2 * 10^{-3}$ | 1.64 | 68.1 | 900 | $>10^3$ | $>10^4$ |
| Bismuth (Bi) | 544.4 | 1837 | 0.5 | 10 | 100 | $10^3$ | $10^4$ | $10^5$ |
| Antimony (Sb) | 903.8 | 1860 | 1 | 100 | $10^3$ | $10^4$ | $2 * 10^4$ | $10^5$ |

<Comparison of the Melting Point, Boiling Point and Vapor Pressure for Tin, Lead, Bismuth and Antimony>.

Then, after the step S160, for removing the refined tin from the vacuum furnace (300), cooling the tin until it reach the approximately 20° C.~30° C. at the cooling rate of 5° C.~30° C. per minute. Then, let the refined tin removed impurities cooled to the room temperature (S170).

After removing the refined tin, which is removed the impurities, from the vacuum furnace (300), wash the tin with a nitrogen gas to wash-off the carbon or other pollutant particles from the product. Then, complete the manufacture process of the tin (S180).

On the other hand, the high-purity tin is manufactured, according to the temperature, pressure and time setting as described above. The produced tin is analyzed by the ICP-MS instrument. As seen in Table 2 below, the impurities, such as a lead and bismuth are remarkably reduced. In Table 2, the concentration represents weight % (wt %) and ppb (Parts Per Billion).

TABLE 2

| | Temperature (° C.) | Pressure (millitorr) | Time (hr) | Lead (pb) concentration (ppb) | Bismuth (Bi) concentration (ppb) |
|---|---|---|---|---|---|
| Tin (Sn) | — | — | — | 117378.37 | 29253.17 |
| Experiment 1 | 1000 | 30 | 3 | 13.36 | 43.56 |
| Experiment 2 | 1100 | 30 | 4 | 29.37 | 76.01 |
| Experiment 3 | 1200 | 30 | 6 | No Detected | 74.03 |
| Experiment 4 | 1300 | 30 | 3 | 0.28 | 243.35 |
| Experiment 5 | 1260 | 0.01 | 2 | 5.89 | 0.82 |
| Experiment 6 | 1200 | 0.01 | 4 | 0.73 | 0.55 |

<Comparison of the Concentration of Lead and Bismuth in the Crude Tin and Vacuum Refined Tin>

As an example, the experiment 6 is described, when the vacuum furnace (300) operates to refine the crude tin with the temperature of 1200° C., pressure of 0.01 mm Torr for 4 hours, the concentration of lead is measured 0.73 ppb, the concentration of bismuth is measured 0.55 ppb.

On the other hand, the 99.9% of crude tin (or tin alloy, tin (Sn)+silver (Ag) or tin (Sn)+copper (Cu)) is placed in a vacuum furnace (300), then operate the refining under the condition of experiment 1, at the temperature of 1000° C., and the pressure of 30 mm Torr for 3 hours. Perform the additional refining under the temperature of 1000° C., and the pressure of 0.01 mm Torr for 3 hours, the refined tin is measured 0.0021 cph/$cm^2$~0.0025 cph/$cm^2$ emitted the alpha radiation. The 99.99% of crude tin (or tin-alloy, tin (Sn)+silver (Ag) or tin (Sn)+copper (Cu)) is placed in a vacuum furnace (300), then operate the refining under the condition of experiment 1 at the temperature of 1000° C., and the pressure of 30 mm Torr for 3 hours, the refined tin is measured 0.0001 cph/$cm^2$~0.0005 cph/$cm^2$ emitted the alpha radiation.

Accordingly, the present invention can be minimized the occurrence of the software errors caused by alpha radiation emitting from the semiconductor devices. The technology of the present invention can be used to develop the pure tin or tin-alloy solder in the electronic industry, which is compliant with the Restriction of Hazardous Substances Directive (WEEE) and the Disposal of Electrical and Electronic Equipment (RoHS). A pure tin can be used in the electroplating as the anode, as well as the vacuum evaporating target.

Although the preferred embodiment of the present invention has been disclosed for illustrative purposes, those skilled in the art will appreciate that various modifications, additions and substitutions are possible, without departing from the scope and spirit of the invention as disclosed in the accompanying claims

What is claimed is:

1. A method of producing a tin, which emits low alpha radiation, by using a vacuum refining, the method is comprised of steps of:

(A) preparing a crude tin (S110);

(B) containing said crude tin in a crucible and placing it in a vacuum furnace (S150), and (C) removing impurities, which have higher vapor pressures and lower boiling points than that of the crude tin from the vacuum furnace (S160), wherein the removing step is further consisting of supplying steam to said vacuum furnace at a temperature 1000° C.~4300° C., at a pressure 0.01~30 millitorr and for 2-6 hours to remove the impurities from said crude tin for obtaining a purified tin.

2. The method according to claim 1, the steps are further comprising between the steps (A) and (B):

(A1) washing said crude tin with a hydrochloric acid (S120), and (A2) washing said crude tin, which is washed through the previous step (A1) selected from the group consisting of an acetone, ethanol and distilled water, then drying it (S130).

3. The method according to claim 1, the step (B) is further comprising an inter-step:

(B1) cleaning inside of the crucible, which will be contained said crude tin, and placed in the vacuum furnace, with a hydrochloric acid (S140).

4. The method according to claim 1, the steps are further comprising after the step (C):

(D) cooling said vacuum furnace until it reaches approximately 20° C.~30° C. at cooling rate of 5° C.~30° C. per minute (S170); and (E) washing said purified tin, with nitrogen gas and further removing contaminated particles (S180).

5. The method according to claim 1, wherein the step (A) is further comprising a detail step in order to obtain a large surface area per a volume;

forming said crude tin selected from the group consisting of a grain shape through granularity, a thin sheet shape through press-rolling and a wide plate shape through casting.

* * * * *